US007331704B2

(12) United States Patent
Howk et al.

(10) Patent No.: US 7,331,704 B2
(45) Date of Patent: Feb. 19, 2008

(54) START-UP METHOD FOR DRAFT TUBE MIXING

(75) Inventors: Richard Howk, Pittsford, NY (US); Michael Giralico, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 394 days.

(21) Appl. No.: 11/057,250

(22) Filed: Feb. 15, 2005

(65) Prior Publication Data

US 2006/0180948 A1 Aug. 17, 2006

(51) Int. Cl.
*B01F 3/12* (2006.01)
*B01F 5/10* (2006.01)
*B01F 5/12* (2006.01)

(52) U.S. Cl. ..... 366/262; 366/270

(58) Field of Classification Search ..... 366/262, 366/263, 264, 265, 266, 267, 268, 269, 270
See application file for complete search history.

(56) References Cited

U.S. PATENT DOCUMENTS 1,891,122 A * 12/1932 Urch ..... 366/343
3,410,535 A * 11/1968 Balassa ..... 366/270
3,532,327 A 10/1970 Landberg
4,089,620 A * 5/1978 Ravitts ..... 417/61
4,378,165 A * 3/1983 Landberg ..... 366/270
4,459,030 A 7/1984 Weetman ..... 366/262
4,647,215 A * 3/1987 Armitage et al. ..... 366/266
4,685,868 A * 8/1987 Bodensteiner et al. ..... 417/405
4,746,221 A * 5/1988 Okumura et al. ..... 366/142
4,871,448 A * 10/1989 Dobryakov et al. ..... 209/169
4,981,366 A * 1/1991 Wickoren ..... 366/262
5,727,742 A * 3/1998 Lawson ..... 241/199.12

* cited by examiner

*Primary Examiner*—Tony G. Soohoo
(74) *Attorney, Agent, or Firm*—Baker & Hostetler LLP

(57) ABSTRACT

A method for suspending settled solids in a liquid using a mixing assembly having a mixing vessel, draft tube disposed within the mixing vessel and an impeller disposed within the draft tube. The method includes rotating the impeller in a first rotational direction for a first period of time so as to cause the liquid to flow in a first axial direction. The method also includes rotating the impeller in a second rotational direction so as to cause the liquid to flow in a second axial direction opposite the first axial direction.

19 Claims, 2 Drawing Sheets

START-UP METHOD FOR DRAFT TUBE MIXING

FIELD OF THE INVENTION

This invention relates generally to a method for the start-up of mixing systems that employ draft tube apparatuses, for example. More particularly, the present invention relates, for example, to an improved method for the start-up of draft tube systems or the like, in conditions having high concentration of settled solids, for example.

BACKGROUND OF THE INVENTION

Mixing tank arrangements for processing liquid and solid material sometimes employ a draft tube or the like. The draft tube typically is arranged or oriented within the mixing tank or vessel so that it extends below the level to which solids may settle. The mixing tank arrangements typically employ a down-pumping impeller near the top of the draft tube along with flow control vanes near the down-pumping impeller. Typical draft tube designs utilized in the art also may include vertical slots extending from the bottom or bottom rim of the draft tube to above the level to which solids may settle. The vertical slots function to allow the startup of the mixing tank in conditions where the solids have settled by solids by enabling the solids that have settled in the mixing tank, due to inactivity of the mixing tank, to pass through the tops of the vertical slots. The flow of the settled solids through the tops of the vertical slots usually functions to scour away and re-suspend the settled solid material in the tank region adjacent the vertical slots.

Many processes require suspension of solid particles in a liquid within a tank. Mixing tank arrangements utilizing a draft tube are commonly used to accomplish the aforementioned suspension as previously discussed above. Oftentimes circumstances arise which require that these mixing processes be shut down or halted for various reasons and long periods of time. During these shut-down times or periods of inactivity, the solids that are suspended in the liquid mixture begin to settle at the bottom of the mixing tank. As previously discussed, draft tubes often extend into the mixing vessel in which they are disposed so that their lower ends are submerged in, or extend into, the settled solids. This orientation or positioning of the draft tube wherein the lower end of the draft tube is submerged, oftentimes causes difficulty during startup of the mixing vessel. This difficulty oftentimes is the result of the settled solids clogging the lower end of the draft tube, preventing the impeller from being started.

Methods currently employed in the art that address the aforementioned startup problem include first, draining the mixing vessel and removing or shoveling the settled solid material away from the bottom of the draft tube to clear the opening in the bottom of the draft tube. Once the opening of the draft tube is cleared, the mixing vessel is refilled with the liquid and the impeller is started and the solids are then added back to the mixing vessel.

Another method currently employed in the art is to set up and arrange pipes that extend to the bottom of the mixing vessel. These pipes proceed to extend into the vessel and into the bottom region of the draft tube. Next, pressurized or compressed air is provided or forced through the pipes to agitate and loosen the settled solids. The compressed air enables the liquid to move through solid material and begin to scour away and suspend and/or re-suspend the particles of the settled solids.

Still another method currently used in mixing assemblies or mixing apparatuses is to limit the length of the draft tube and not extend the draft tube a specified distance. For example, in these arrangements, the draft tube extends into the mixing vessel however it does not extend into or below the level of the settled solids.

The aforementioned solids re-suspension methods and apparatuses have drawbacks however. Some methods and apparatuses, as previously discussed, require expensive auxiliary equipment adding cost while others require shut-down time which also adds cost to the operation of the mixing vessel. Furthermore, when solids loading of the mixing vessel is increased, oftentimes the impeller is unable to provide the necessary head to overcome the mixing system resistance. In these increased solids loading conditions, re-suspension may cause the mixing system power requirements to increase until possible overload of the motor driving the impeller. Furthermore, in draft tube systems similar to the ones previously described, motor overloads and subsequent process failure may be experienced in start up conditions having high concentration of settled solids. This is oftentimes due to mixing systems lacking significant enough velocity head to break the interface between the liquor and the settled solids without overloading or short circuiting the mixing system flow pattern.

Accordingly, there is a need in the art to provide an apparatus and method for the re-suspension of settled solids or the like, in mixing systems or similar apparatuses. It is desirable to provide a system and method for re-suspension of settled solids, for example high concentrated alumina solids, that does not require auxiliary equipment. It is further desirable to provide a system and method for re-suspension of settled solids, for example high concentrated alumina solids, that does not require high velocity head during system start-up, requiring additional system power requirements.

SUMMARY OF THE INVENTION

The foregoing needs are met, to a great extent, by the present invention, wherein aspects of a mixing assembly start-up method are provided.

In accordance with an embodiment of the present invention, a method for suspending settled solids in a liquid using a mixing assembly having a longitudinal axis, a mixing vessel, a draft tube having suspension slots extending at least partially between a first end and a second end, wherein the draft tube is disposed within the mixing vessel and an impeller disposed within said draft tube is provided, comprising: rotating the impeller in a first rotational direction for a first period of time, wherein said rotating of the impeller in the first rotational direction causes the liquid to flow in a first axial direction along the longitudinal axis; and rotating the impeller in a second rotational direction opposite the first rotational direction for a second period of time, wherein said rotating of the impeller in the second rotational direction causes the liquid to flow in a second axial direction along the longitudinal axis opposite the first axial direction.

In accordance with another embodiment of the present invention, a method for a suspending settled solids in a liquid using a mixing assembly having a longitudinal axis and a mixing vessel for containing liquid and solid materials is provided, comprising: disposing a draft tube within in the mixing vessel; disposing an impeller within the draft tube; rotating the impeller in a first rotational direction; and rotating the impeller in a second rotational direction opposite the first rotational direction.

In accordance with yet another embodiment of the present invention, A mixing apparatus for mixing a liquid mixture or the like having a longitudinal axis is provided, comprising: a mixing vessel; a draft tube disposed within said mixing vessel; an impeller disposed within said draft tube; a shaft to drive said impeller; a motor to drive said shaft; and a controller to operate the motor to drive the shaft in a first direction and a second direction.

In accordance with still another embodiment of the present invention, a mixing assembly for suspending settled solids in a liquid or the like, having a longitudinal axis, comprising: a mixing vessel; a draft tube having suspension slots extending at least partially between a first end and a second end, wherein the draft tube is disposed within the mixing vessel; and an impeller disposed within said draft tube, comprising: means for rotating the impeller in a first rotational direction for a first period of time, wherein said rotating of the impeller in the first rotational direction causes the liquid to flow in a first axial direction along the longitudinal axis; and means for rotating the impeller in a second rotational direction opposite the first rotational direction for a second period of time, wherein said rotating of the impeller in the second rotational direction causes the liquid to flow in a second axial direction along the longitudinal axis opposite the first axial direction.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
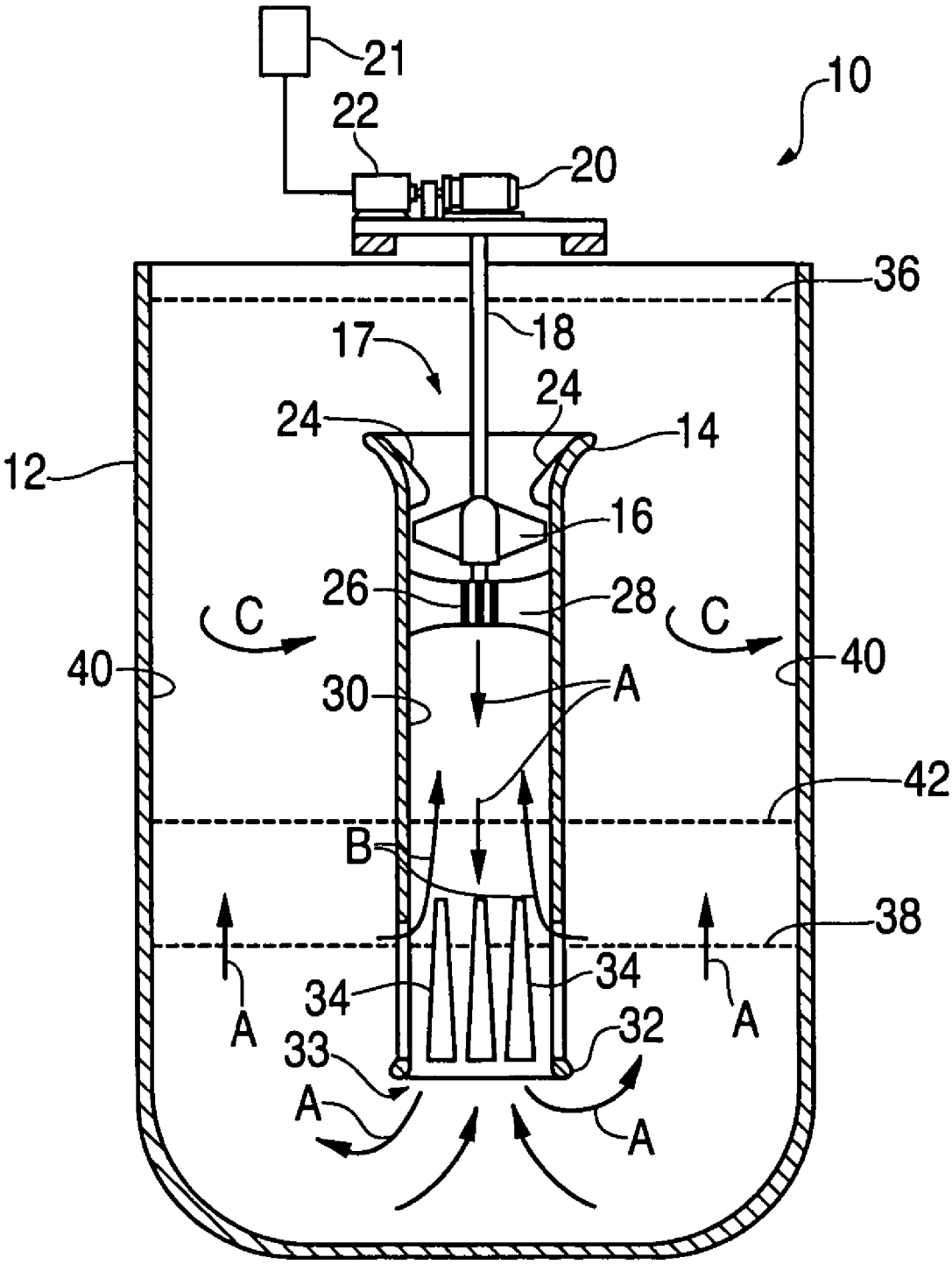
FIG. 1 is a schematic cross-sectional view of a mixing assembly having a draft tube in accordance with an embodiment of the present invention.

Various preferred embodiments of the present invention provide for a re-suspending of settled solids, such as alumina, in mixing systems or the like. It should be understood, however, that the present invention is not limited in its application to mixings systems or the suspension of alumina, but, for example, may be used with other processes and/or apparatuses requiring the suspension or re-suspension of solids. Preferred embodiments of the invention will now be further described wither reference to the drawing figures, in which like reference numerals refer to like parts throughout.

Referring now to FIG. 1, a mixing assembly, generally designated 10, is depicted for mixing a liquid in which a solid material is suspended. The mixing assembly 10 includes a mixing vessel 12 and a draft tube 14 positioned at a central location within the mixing vessel 12. The mixing assembly 10 also includes an impeller 16 that is preferably positioned at the at the top 17, or near the top 17 of the draft tube 14. As illustrated in FIG. 1, the impeller 16 is connected to a rotatable shaft 18 which is connected to a gear drive 20 which is driven by a motor 22. The motor 22 and gear drive 20 operate in one mode to rotate or turn the shaft 18 in a first direction so that the impeller 16 pumps, or down pumps, liquid material downward through the draft tube 14 as indicated by the arrows A. The motor 22 and gear drive 20 also operate in another mode to rotate or turn the shaft 18 in an opposite, second direction so that the impeller 16 pumps, or up pumps, the liquid material upward through the draft tube 14 as indicated by arrows B. A controller 21 can be provided to control the direction of rotation of the motor 22. The controller 21 can be a simple two-direction switch or a programmed device such as a computer.

The mixing assembly 10 further includes vanes 24 connected to the draft tube 14. As illustrated in FIG. 1, the vanes 16 are positioned above the impeller 16 near the top 17 of the draft tube 14. The vanes 16 function to guide the liquid material downward to the impeller 16 when the impeller 16 is rotated in the aforementioned first direction. The mixing assembly 10 may also include a steady rest or bearing 26 located at the lower end of the rotatable shaft 18 along with vertical vanes 28. The steady rest or bearing 26 functions to house the lower end of the shaft 18 while the vertical vanes 28 preferably extend from the steady rest or bearing 26 to the side wall 30 of the draft tube 14. During the rotation of the impeller 16 in the first direction, or down pumping, the vertical vanes 28 function to guide the pumped liquid material downward through the draft tube 14 while reducing the likelihood of swirling.

As depicted in FIG. 1, the draft tube 14 includes a rim 32 that is formed around the bottom 33 of the draft tube 14. The draft tube 14 also includes a plurality of suspension slots 34 that are formed in the wall 30 of the draft tube 14 above the rim 32. As illustrated, the rim 32 of the draft tube 14 extends below the level of settled solids 38 and the suspension slots 34 extend upward, above the indicated level of settled solids 38. Thus, the bottom 33 of the draft tube 14 is submerged in solid material when the solids have settled, for example during shut-down of the mixing assembly 10.

Depending upon the parameters such as the area of the draft tube 14, the area of the mixing vessel 12, the concentration of liquid and solid material involved and the pumping rate of the impeller 16, the slots 34 are preferably arranged to extend above the settled solid level 22, as depicted in FIG. 1. Furthermore, several suspension slots 34 are generally preferred per draft tube 14, and as the size of the mixing vessel 12 and draft tube 14 increase, the number of the suspension slots 34 utilized by the mixing assembly 10 can increase.

Also, the suspension slots 34 preferably have a tapered geometry. As illustrated in FIG. 1, the suspension slots 34 have a geometry that includes wide bottom portions or sections with narrow top portions. This geometry of the suspension slots 34 provides for the least resistance to liquid flow at the bottom of the suspension slots 34. This minimum resistance at the bottoms of the suspension slots 34 encourages minimum passage of liquid through the upper portions of the suspension slots 34 during standard operation of the mixing assembly 10 in conditions where the solids are completely suspended. The previously described minimum passage of the liquid through the upper portions of the suspension slots 34 during standard operation is because the liquid flow or down pumping from the impeller 16 tends to travel a considerable distance before diverging appreciably, and because the least resistance to its divergence is at the broad bottom portions of the slots 34.

The above-described preferred suspension slot 34 orientation typically allows for a sufficient area for the mixing assembly to start-up. The orientation also allows for the desired scouring away and clearing of the settled solids at the bottom of the mixing vessel 12. As FIG. 1 illustrates, the normal operating liquid level within the mixing vessel 12 generally designated 36. FIG. 1 also illustrates the level of settled solid material in the mixing vessel 12, generally designated 38, if settling of the solid material is allowed to occur. As depicted in FIG. 1, the upper portions of the suspension slots 34 extend above the settled solid material 38 as previously described. Of course, during normal operation of the mixing assembly 10, the solid material is suspended in the liquid within the mixing vessel 12, and the level 38 is discernible only after shutdown and the solid material is allowed to settle.

The suspension slots 34 also function to equalize the pressure inside and outside the draft tube 14. This equalization is preferred prior to start-up of the mixing assembly 10 when the settled solids may be of sufficient height that they may clog the bottom 33 of the draft tube 14. If solids are suspended in the liquid or liquor outside the draft tube 14 while clear liquid or liquor is present inside the draft tube 14 prior to start-up, the outside liquid has a greater specific gravity. The existence of the greater specific gravity, as previously described, may press inward in certain conditions or circumstances with sufficient force to damage or collapse the draft tube 14. In these circumstances, the suspension slots 34 can provide liquid communication between the inside and outside areas of the draft tube 14, preventing the likelihood of the draft tube 14 being damaged from the specific gravity pressures.

During standard operation of the mixing assembly 10, the mixing vessel 12 is charged with liquid such as liquor and solid material such as alumina and the impeller 16 is driven in the aforementioned first direction. During standard operation, the rotation of the impeller 16 down pumps, forcing a jet stream of liquid downward through the inside of the draft tube 14 toward the bottom of the mixing vessel 12. As the liquid is forced downward through the draft tube 14, as indicated by the arrows A, the flow or jet stream approaches the bottom of the mixing vessel 12 where it is turned and deflected upward, as indicated by arrows A, creating a flow rising around the side wall 40 of the mixing vessel 12.

The above-described flow pattern that exists during the standard operation of the mixing assembly 10 functions to scour away and maintain the liquid suspension of the solid materials that tend to settle in the mixing vessel 12. As the liquid flow approaches the top of the draft tube 14, the liquid with solid material suspended therein, flows inward toward the draft tube 14 away from the side wall 40, and again is pumped downward through the draft tube 14, as previously described, in continuous circulation within the mixing vessel 12.

Oftentimes increased solids loading of the mixing system 10 is desired. During start-up of the mixing assembly 10 under these increased solids conditions after a shut-off period, the settled solids can be much higher causing the level of increased solids 38 to extend to a level that exceeds the slots 34, for example a level as high as that indicated by line 42. Under these conditions, sufficient area that enables the scouring away and clearing of the settled solids at the bottom of the mixing vessel 12, as previously discussed, may not exist. It therefore may be difficult for the impeller 16 to provide the necessary head to overcome the resistance to the mixing system 10.

Accordingly, during start-up of the mixing assembly 10 in high concentration conditions such as the one described above, wherein the solids load is high, the mixing assembly 10 is initially operated in start-up mode. By start-up mode, it understood that the impeller 16 is driven or operated in the reverse or the opposite direction than during standard operation of the mixing assembly 10. The impeller 16 is rotated in the reverse direction, causing upflow from the suction head within the draft tube 14 as indicated by arrows B. This creates a head differential. The resulting flow will discharge as a swirling area of liquor (flow) in the tank and the draft tube liquor initially begins to re-suspend the settled solids as indicated by C. The aforementioned re-suspension of the settled solids provides a higher density liquor which is capable of breaking through the liquid-solid interface of the mixing system 10 that results from the settling of the solids. The aforementioned re-suspension of the settled solids also functions to re-suspend a portion of the settled solids so as to uncover the suspension slots 34 of the draft tube 14.

The above-described operation of the mixing assembly 10 in the start-up mode, i.e., with the impeller 16 driven or operated in the reverse or the opposite direction than rotation during standard operation, enables the mixing assembly 10 to be started in conditions having high concentration of settled solids. The above-described operation of the mixing assembly 10 in the start-up mode also prevents the likelihood of motor 22 overload during start-up of the mixing assembly 10 due to high head conditions which can be caused by high system head resulting from the high concentration of settled solids.

Figure 2:
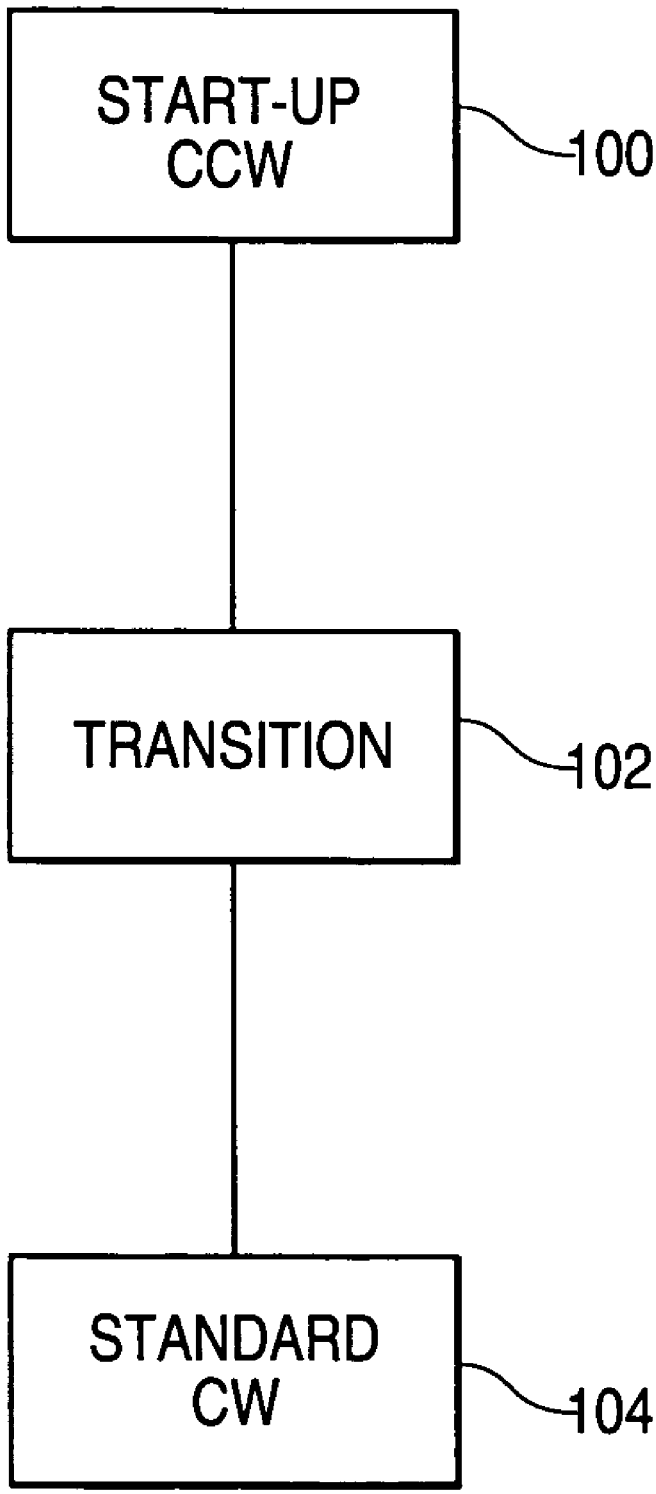
FIG. 2 is a flowchart of the steps employed in a method for mixing with a draft tube in accordance with a preferred embodiment of the present invention.

Referring now to FIGS. 1 and 2 is a flowchart of steps according to a preferred of method of the present invention. As previously described, during high concentration conditions wherein resulting from the increased loading of solids, the mixing assembly 10 is preferably operated first in the start-up mode 100 as illustrated in FIG. 2. During start-up mode 100, the controller 21 can be utilized to rotate the impeller 16 in the reverse direction. The mixing assembly 10 is operated in start-up mode 100 or the reverse direction for desired amount of time. The aforementioned desired amount of time may vary, however it is preferably the amount of time needed to create an upflow of liquor within the draft tube 14, which breaks through the liquid-solid interface and uncovers the suspension slots 34.

Once start-up 100 is complete and the suspension slots are uncovered, the mixing assembly is transitioned 102 from start-up 100 to standard operation 104 as indicated in FIG. 2. During transition 102, the controller 21, as depicted in FIG. 1, is utilized to stop the reverse rotation of the impeller 16. As the reverse rotation is stopped, the controller 21 is utilized to immediately transition 102 the mixing assembly 10 into the standard operation mode 104, wherein the liquid is now down pumped through the draft tube 14 as previously described.

The aforementioned methods as illustrated in FIG. 2 may be manually performed or automatically carried out as a series of pre-programmed steps. For example, the controller 21 depicted in FIG. 1, may be a two-direction switch in which case the method illustrated in FIG. 2 is manually performed. Alternatively, the controller 21 may be a pre-programmed device such as a computer, wherein a desired amount of time for operation may be programmed for each mode, start-up 100, transition 102 and standard 104. During the automated operation of the mixing assembly 10, the controller 21 may be programmed to operate in start-up 102 for 25 minutes and then transition 102 to standard 104 for a desired period of time, with little or no delay between start-up 100 and standard 104, for example. The amount of operation time for each individual mode, start-up 100, transition 102 and standard 104, may vary depending the mixture concentration, etc.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for suspending settled solids in a liquid using a mixing assembly having a longitudinal axis, a mixing vessel, a draft tube having vertical slots extending a vertical slot distance at least partially between a first end and a second end of the draft tube, wherein the draft tube is disposed within the mixing vessel and an impeller disposed within said draft tube, comprising:

filling the mixing vessel so that a solid suspension level is located at a height on the vertical slot distance of the suspension slots;

rotating the impeller in a first rotational direction for a first period of time, wherein said rotating of the impeller in the first rotational direction causes the liquid to flow in a first axial direction along the longitudinal axis; and rotating the impeller in a second rotational direction opposite the first rotational direction for a second period of time, wherein said rotating of the impeller in the second rotational direction causes the liquid to flow in a second axial direction along the longitudinal axis opposite the first axial direction.

2. The method according to claim 1, wherein the step of rotating the impeller in the first rotational direction for the first period of time causes an up-pumping flow orientation within the draft tube.

3. The method according to claim 2, wherein the step of rotating the impeller in the second rotational direction for the second period of time causes a down pumping flow orientation within the draft tube.

4. The method according to claim 3, wherein the step of rotating the impeller in the first rotational direction occurs during start up of the mixing assembly and wherein the first period of time is a time period is sufficient enough to suspend the settled solids to uncover the suspension slots.

5. A method for a suspending settled solids in a liquid using a mixing assembly having a longitudinal axis and a mixing vessel for containing liquid and solid materials, comprising:

disposing a draft tube within in the mixing vessel, wherein the draft tube has a side wall that further comprises a plurality of vertical slots each having tops and bottoms, wherein the vertical slots extend from adjacent the first end of the draft tube at least partially all the way to the second end of the draft tube, thereby extending a vertical slot distance and wherein the vertical slots are each tapered to have a bottom width that is greater than a top width thereof;

disposing an impeller within the draft tube;

filling the mixing vessel so that a solid suspension level is located at a height on the vertical slot distance of the suspension slots;

rotating the impeller in a first rotational direction; and rotating the impeller in a second rotational direction opposite the first rotational direction.

6. The method according to claim 5, wherein said rotating of the impeller in the first rotational direction causes the liquid to flow in a first axial direction along the longitudinal axis.

7. The method according to claim 6, wherein said rotating of the impeller in the second rotational direction causes the liquid to flow in a second axial direction along the longitudinal axis opposite the first axial direction.

8. The method according to claim 7, wherein the step of rotating the impeller in the first rotational direction for the first period of time causes an up-pumping flow orientation within the draft tube.

9. The method according to claim 8, wherein the step of rotating the impeller in the second rotational direction for the second period of time causes a down pumping flow orientation within the draft tube.

10. The method according to claim 5, wherein the draft tube comprises:

a first end;

a second end that opposes said first end; and a curved side wall that extends between said first end and said second end.

11. The method according to claim 10, further comprising a means for rotating the impeller.

12. The method according claim 10, further comprising generally vertical flow control vanes arranged within the draft tube near the second end of the draft tube.

13. The method according claim 5, wherein the vertical slots extend above the level of settled solids.

14. A mixing apparatus for mixing a liquid mixture or the like having a longitudinal axis, comprising:

a mixing vessel;

a draft tube disposed within said mixing vessel, wherein the draft tube has a side wall that further comprises a plurality of vertical slots each having tops and bottoms, wherein the vertical slots extend from adjacent the first end of the draft tube at least partially all the way to the second end of the draft tube, thereby extending a vertical slot distance and wherein the vertical slots are each tapered to have a bottom width that is greater than a top width thereof;

an impeller disposed within said draft tube;

a shaft to drive said impeller;

a motor to drive said shaft; and a controller to operate the motor to drive the shaft in a first direction and a second direction.

15. The mixing apparatus according to claim 14, wherein operation of said shaft in said first direction forces the liquid mixture to flow in a first axial direction along the longitudinal axis.

16. The mixing apparatus according to claim 15, wherein operation of said shaft in said second direction forces the liquid mixture to flow in a second axial direction along the longitudinal axis opposite the first axial direction.

17. The method according to claim 16, wherein operation of said shaft in the second direction for the causes a down pumping flow orientation within said draft tube.

18. The mixing apparatus according to claim 15, wherein the operation of said shaft in the first direction causes an up-pumping flow orientation within said draft tube.

19. A mixing assembly for suspending settled solids in a liquid or the like, having a longitudinal axis, comprising:

a mixing vessel;

a draft tube disposed within the mixing vessel and having a side wall, wherein the side wall further comprises a plurality of vertical slots each having tops and bottoms, wherein the vertical slots extend from adjacent the first end of the draft tube at least partially all the way to the second end of the draft tube, thereby extending a vertical slot distance and wherein the vertical slots are each tapered to have a bottom width that is greater than a top width thereof; and an impeller disposed within said draft tube, comprising:

means for rotating the impeller in a first rotational direction for a first period of time, wherein said rotating of the impeller in the first rotational direction causes the liquid to flow in a first axial direction along the longitudinal axis; and means for rotating the impeller in a second rotational direction opposite the first rotational direction for a second period of time, wherein said rotating of the impeller in the second rotational direction causes the liquid to flow in a second axial direction along the longitudinal axis opposite the first axial direction.

* * * * *